United States Patent [19]

Young

[11] Patent Number: 4,697,637

[45] Date of Patent: Oct. 6, 1987

[54] TUBE SUPPORT AND FLOW DIRECTOR

[75] Inventor: Richard K. Young, Bartlesville, Okla.

[73] Assignee: Phillips Petroleum Company, Bartlesville, Okla.

[21] Appl. No.: 326,777

[22] Filed: Dec. 2, 1981

[51] Int. Cl.[4] ..... F28D 7/00; F28F 9/00; F28F 9/22

[52] U.S. Cl. ..... 165/160; 165/162; 165/159

[58] Field of Search ..... 165/109 R, 159, 160, 165/161, 162, 163; 122/510

[56] References Cited

U.S. PATENT DOCUMENTS

| | | | |
|---|---|---|---|
| 1,882,474 | 10/1932 | Black . | |
| 1,929,376 | 10/1933 | Trainer et al. | 257/227 |
| 1,946,234 | 2/1934 | Price | 165/162 |
| 1,987,051 | 1/1935 | Cattanach | 257/223 |
| 2,018,037 | 10/1935 | Sieder | 257/239 |
| 2,036,957 | 4/1936 | Price | 165/162 |
| 2,059,967 | 11/1936 | Leach | 257/223 |
| 2,229,344 | 1/1941 | Schneider | 165/162 |
| 2,384,149 | 9/1945 | Villiger | 257/224 |
| 2,402,881 | 6/1946 | Fausek et al. | 257/220 |
| 2,655,346 | 10/1953 | Corbitt et al. | 257/16 |
| 2,693,942 | 11/1954 | Guala | 257/224 |
| 2,830,797 | 4/1958 | Garland | 257/43 |
| 3,055,721 | 9/1962 | Holt | 108/150 |
| 3,228,456 | 1/1966 | Brown et al. | 165/180 |
| 3,277,959 | 10/1966 | Withers | 165/180 |
| 3,292,691 | 12/1966 | Welter et al. | 165/172 |
| 3,420,297 | 1/1969 | Romanos | 122/510 |
| 3,708,142 | 1/1973 | Small | 248/49 |
| 3,820,594 | 6/1974 | Ritland et al. | 165/69 |
| 3,937,277 | 2/1976 | Krolmann | 165/162 |
| 3,941,188 | 3/1976 | Scheidl | 165/162 |
| 3,964,146 | 6/1976 | Vestre et al. | 165/162 |
| 3,967,677 | 7/1976 | Mohlman | 165/162 |
| 4,021,204 | 5/1977 | Straffi | 165/162 |
| 4,036,461 | 7/1977 | Soligno | 165/162 |
| 4,136,736 | 1/1979 | Small | 165/162 |
| 4,299,276 | 11/1981 | Small | 165/162 |

FOREIGN PATENT DOCUMENTS

| | | | |
|---|---|---|---|
| 570115 | 6/1945 | United Kingdom | 165/163 |
| 685848 | 1/1953 | United Kingdom | 165/162 |

OTHER PUBLICATIONS

Small & Young, "Exchanger Design Cuts Tube Vibration Failures", Oil & Gas Journal, Sep. 5, 1977.

*Primary Examiner*—William R. Cline
*Assistant Examiner*—John K. Ford
*Attorney, Agent, or Firm*—John R. Casperson

[57] ABSTRACT

Rod type supports or baffles are disclosed for arrays of tubes, especially those arranged in the form of a tube bundle. Each baffle comprises a pair of arcuate surfaces with a plurality of rods extending therebetween and each rod being non-normally disposed with respect to the axis of a tube bundle. In a preferred embodiment, a plurality of baffles are employed in a tube bundle so as to cause shell side fluid to sweep across the tubes in a spiral pattern, such as a double helical pattern. The invention provides an improvement in the mixing of shell side fluid in a rod baffle heat exchanger.

20 Claims, 17 Drawing Figures

TUBE FLUID IN
SHELL FLUID OUT
SHELL FLUID IN
TUBE FLUID OUT

TUBE SUPPORT AND FLOW DIRECTOR

BACKGROUND OF THE INVENTION

The invention relates to a rod baffle. In another aspect the invention relates to tube bundles. In yet another aspect, the invention relates to heat exchangers, and to a method and apparatus to radially support the tubes in such heat exchangers and to improve shell side fluid flow distribution.

Heat transfer is an important part of any process. As is well known, an indirect transfer of heat from one medium to another is usually accomplished by the use of heat exchangers of which there are many types. For example, there are double pipe, shell and tube, plate heat exchangers and others. Indeed, the art of heat exchanger design has developed to a very high degree; however, there is still room for improvement in a number of areas. For example, in shell and tube heat exchangers, improving tube support, and also improving the flow pattern of shell side fluids.

Plate type baffles have been used in shell and tube heat exchangers for many years. Such baffles provide support for the tubes at least to some degree. The double segmental plate-baffle heat exchanger is well known to those skilled in the art, and although heat exchangers using plate type baffles were a relatively early development in heat exchanger design, such exchangers are still widely used today. In most plate baffled heat exchangers the passages in the plates through which the tubes pass are slightly larger in diameter than the outside diameter of the tubes in order to facilitate construction of the exchanger. As a result vibration of the tubes can and does occur which frequently results in premature tube failure. Also, exchangers utilizing plate baffles suffer from relatively stagnant volumes in the flow of shell side fluid immediately downstream of each baffle, in the sheltered area. Heat transfer is adversely affected. Further, especially where heat exchangers having plate-baffles are utilized for steam generation, localized overheating and vaporization can occur in the stagnant regions, causing scale formation and loss of heat transfer efficiency. Further, scale deposition or crevice corrosion can occur between the baffle and the tube which can lead to tube failure in the bundle.

U.S. Pat. No. 2,693,942, issued to J. R. Guala on Nov. 9, 1954, describes a heat exchanger utilizing plate-baffles arranged so as to provide a helical flow pattern of shell side fluid. A disadvantage of the apparatus disclosed by Guala is that it is extremely difficult to construct. Each baffle comprises two criss cross plates, with each plate being in the form of a segment of an elipse and pierced to permit passage therethrough of the tubes of the bundle. Construction of such a bundle would clearly be quite difficult.

OBJECTS OF THE INVENTION

It is an object of this invention to provide a baffle for a tube bundle which is simple and easy to construct.

It is another object of this invention to provide a baffle set for a tube bundle for causing spiral flow of shell side fluid through the bundle when it is employed in a heat exchanger.

It is a further object of this invention to provide a baffle system for a heat exchanger which improves mixing of shell side fluid to create a more uniform temperature at corresponding positions in the bundle.

Other advantages of this invention will be apparent from the drawings, detailed description of the invention and appended claims.

SUMMARY OF THE INVENTION

According to one aspect of the invention, an apparatus comprises a pair of arcuate surfaces positioned symmetrically with respect to an axis and lying in separate planes generally parallel to the axis and a plurality of rods positioned with their midpoints on the axis and lying in separate generally parallel planes, a first end of each rod affixed to a first of the pair of arcuate surfaces and a second end of each rod affixed to a second of the pair of arcuate surfaces.

According to another aspect of the invention, an apparatus comprises of plurality of tubes forming a tube bundle suitable for use in a shell and tube heat exchanger, the tubes positioned to form at least a first plurality of parallel tube rows and a second plurality of parallel tube rows with lanes between at least a portion of the adjacent tube rows; and at least one baffle set cooperating with the tube bundle to cause longitudinally spiralling flow of shell side fluid through the tube bundle; wherein each baffle of the set comprises at least one outer ring surrounding the tube bundle and having a pair of ends defining a first generally annular surface and a second generally annular surface, the first and the second generally annular surfaces lying in generally parallel planes longitudinally spaced apart along the longitudinal axis of the tube bundle and a plurality of rods each having a first end and a second end and positioned in at least a portion of the lanes between adjacent tube rows in one plurality of parallel tube rows, each of the rods attached by its first end to one of the generally annular surfaces and by its other end to the other of the generally annular surfaces.

In another aspect, the present invention provides a method for improving the capability of the tube bundle for mixing shell side fluid when the tube bundle is to be employed in a shell and tube heat exchanger which utilizes generally longitudinal flow of shell side fluid. The method comprises providing the tube bundle with a plurality of encircling rings spaced apart longitudinally along the tube bundle and dividing the tube bundle into portions, and a plurality of rods extending transversely through each portion of the tube bundle, a plurality of rods in a portion of the tube bundle, each of said rods having a first end affixed to a first end of ring and a second end affixed to a second different end of a ring, the portion of the tube bundle being defined between the first end of a ring and the second different end of a ring so that shell side flows through the tube bundle in longitudinally spiralling flow.

A BRIEF DESCRIPTION OF THE DRAWING

DETAILED DESCRIPTION OF THE INVENTION

Figures 9, 10, 11, 12, 13:
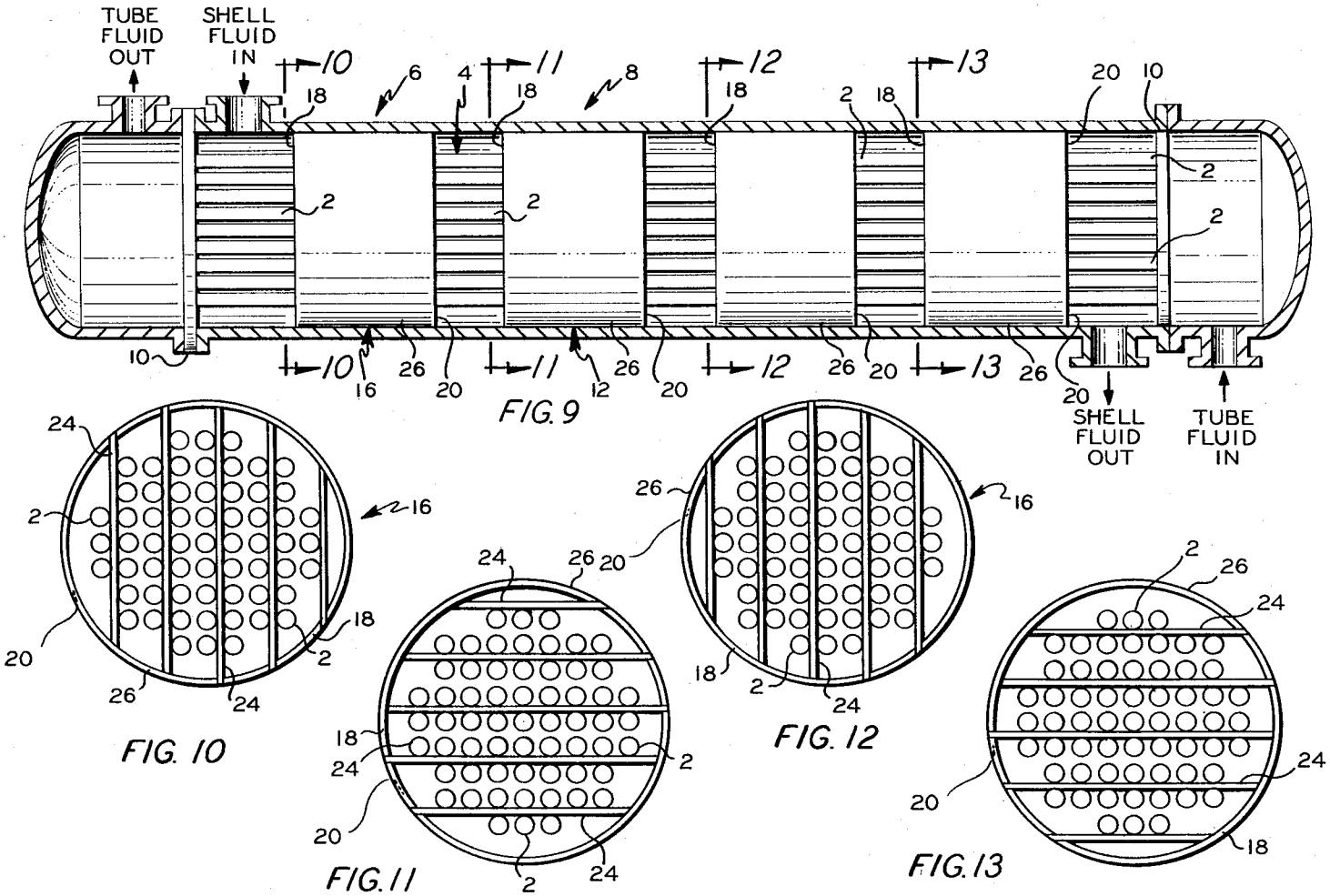
FIG. 9 is a pictorial representation of a tube bundle illustrating certain features of one embodiment of the present invention.
FIGS. 10–13 are cross sectional views of the apparatus of FIG. 9 taken along the indicated lines.
Figure 14:
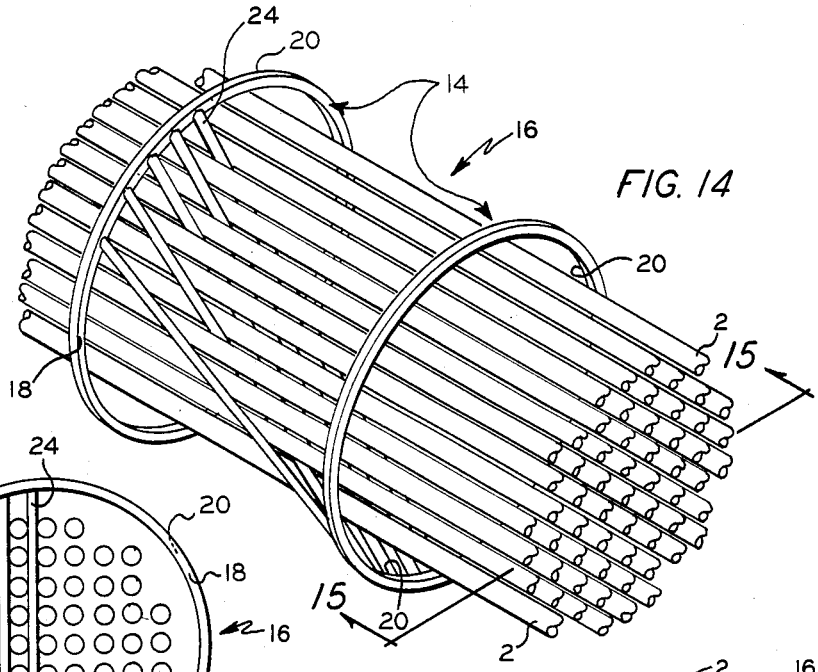
FIGS. 14 and 16 illustrate in isometric view certain features of an embodiment of the invention as deployed in portions of a tube bundle.

In accordance with one aspect of the present invention as best shown by FIG. 9, an apparatus comprises a plurality of tubes 2 forming a tube bundle 4 suitable for positioning in a shell 6 of the shell and tube heat exchanger 8. The tubes 2 are positioned to form at least a first plurality of parallel tube rows and a second plurality of parallel tube rows, with lanes between at least a portion of the adjacent tube rows. The preferred layout of the tube bundle is square pitch, as is best seen in the cross sectional views shown by FIGS. 2, 4, 6, 8 and 10 through 13. Usually, the tube bundle will be provided with a means 10 such as tube sheets for supporting the ends of the tube bundle in the heat exchanger shell. If desired however, the invention can also be utilized with a U-tube type bundle in which instance one of the means 10 would comprise a plurality of U-shaped tube portions connecting half of the tubes of the bundle with the other half. It is expected, however, that best results will be obtained where each end of the tube bundle is supported by a tube sheet.

For ease of construction, it is preferred that the tube bundle 4 comprise an array of tubes 2 laid out on square pitch as illustrated. However, if desired, the tubes 2 could be laid out on a triangular pitch, or, any other pitch, so long as lanes are provided between at least a portion of adjacent tube rows.

The bundle 4 is provided with a means 12 spaced apart longitudinally along the tube bundle for causing generally spiralling flow of shell side fluid through the bundle. According to the invention, the means 12 for causing spiralling flow of shell side fluid through the bundle comprises a set 14 of rod-baffles 16 (See FIG. 1, for example). Generally speaking, a baffle set 14 comprises a sufficient number of baffles to cause a spiral in the flow pattern of the shell side fluid around the longitudinal axis of the bundle. For example, one such baffle set is shown in FIGS. 1–8, while another is shown by FIGS. 9–13. FIGS. 14–17 show one half of a baffle set. It will be appreciated however, that the illustrated tube bundles are preferred embodiments only. Where the tubes of the bundle are laid out on a triangular pitch for example, a baffle set containing only three rod baffles would be necessary to cause a spiral in the flow of shell side fluid.

It is further preferred that the set of rod baffles provide radial support for each tube in the bundle at least once. That is, each baffle set contains a sufficient number of rods to place at least one rod through each lane through the tube bundle. It will be further appreciated that the number of baffles required to provide each tube with radial support is not necessarily the same number as required to cause a spiral in of flow pattern of shell side fluid longitudinally traversing the heat exchanger. For example, in the embodiment of the invention as shown by FIGS. 10–13, rods could be positioned in each lane between adjacent tube rows, and each tube in the tube bundle would be radially supported twice by a single baffle set.

Figure 1:
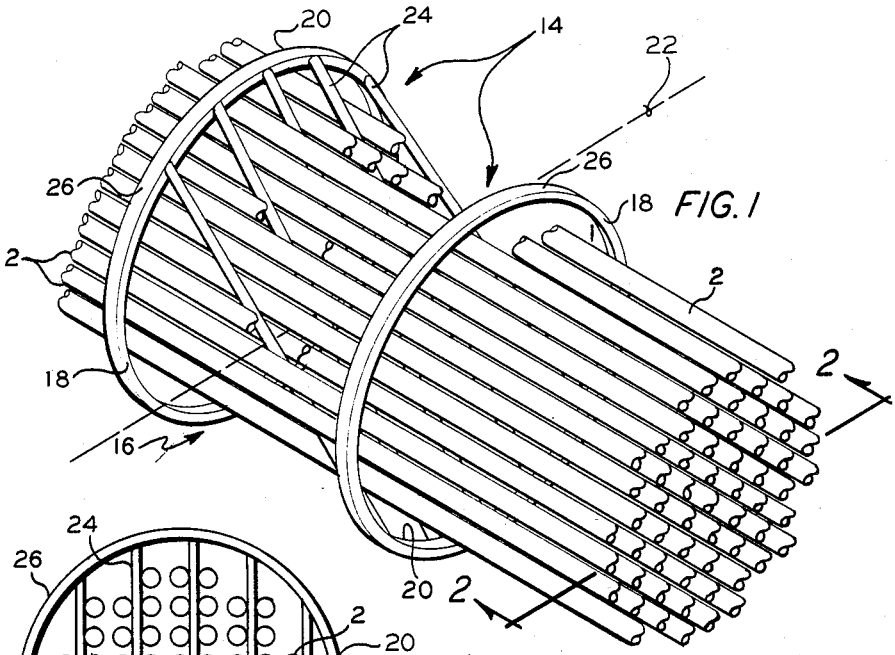
FIGS. 1, 3, 5 and 7 illustrate in isometric view certain features of an embodiment of the invention as deployed in portions of a tube bundle having portions thereof broken away.
Figure 2:
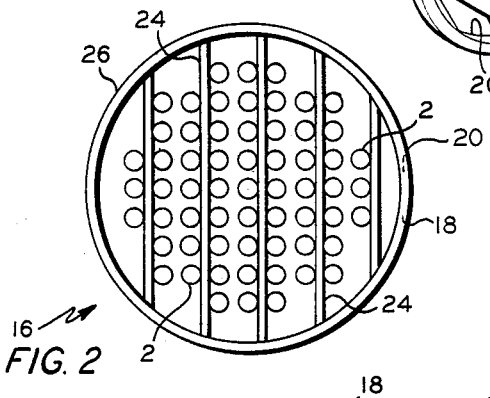
FIGS. 2, 4, 6 and 8 are cross sectional views of FIGS. 1, 3, 5 and 7 respectively, taken along the indicated lines.
Figure 4:
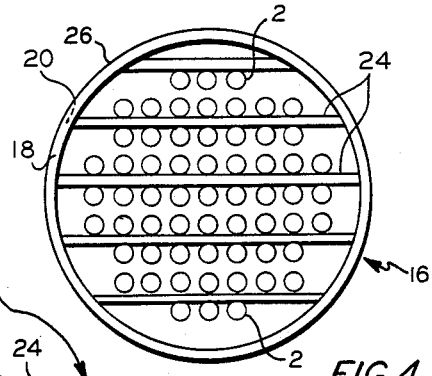
Figure 3:
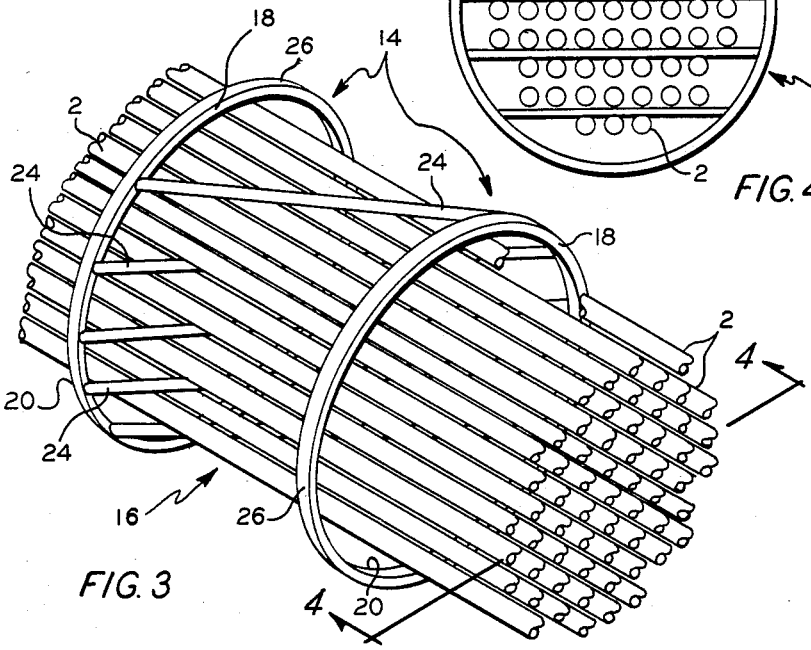
Figure 5:
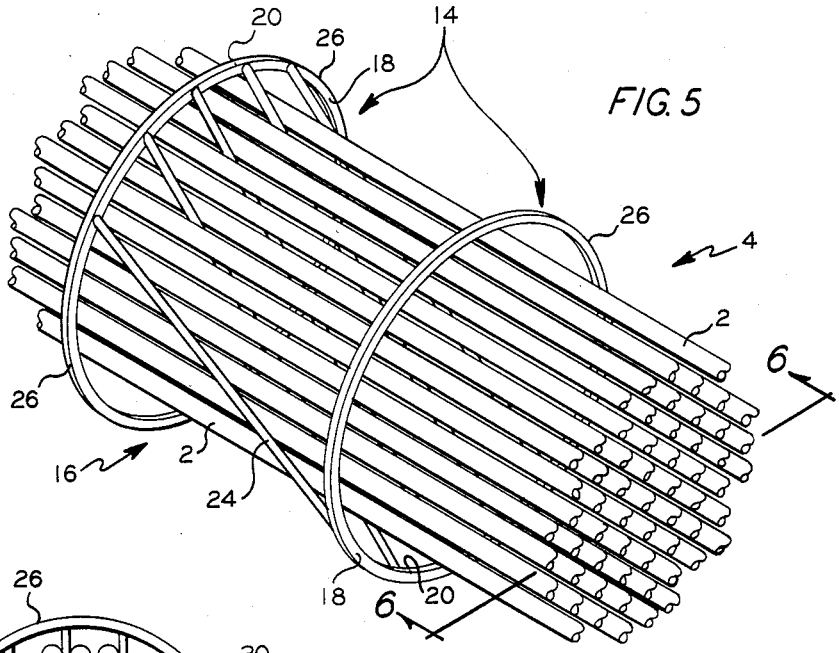
Figure 6:
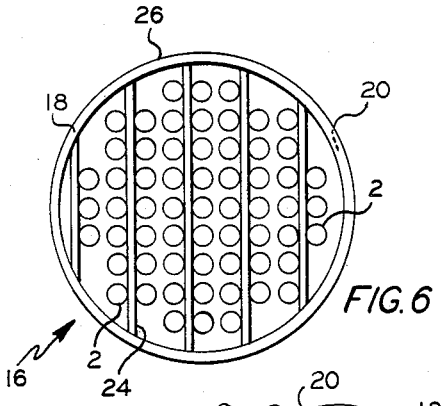
Figure 8:
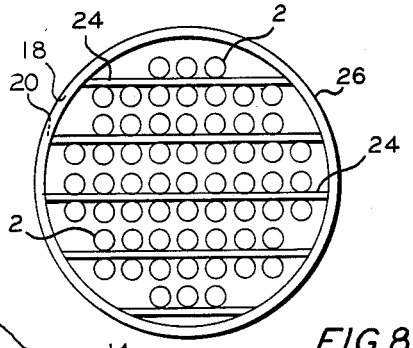
Figure 7:
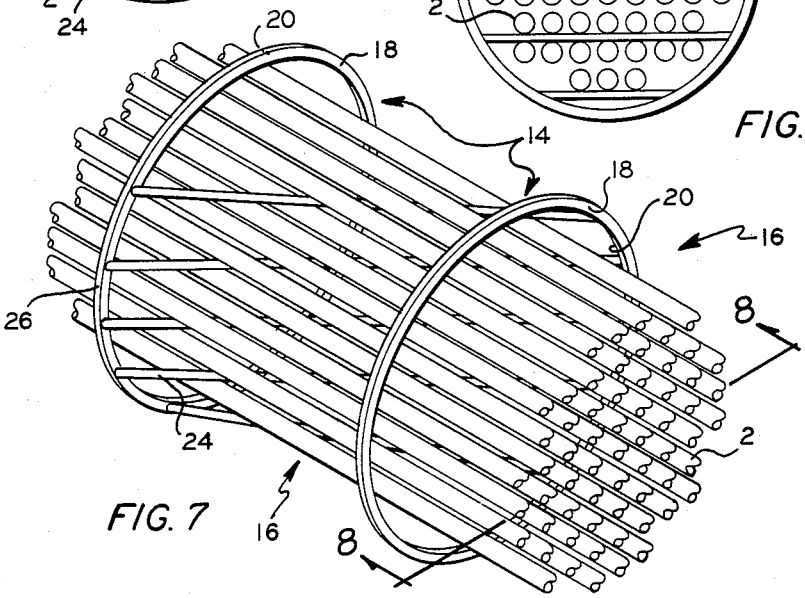

According to certain aspects of the invention, the rod baffle comprises a pair of arcuate surfaces 18 and 20 positioned symmetrically with respect to an axis 22 as shown by FIG. 1 which crosses preferably normally through the tube bundle and lies in separate plane generally parallel to the axis 22; and a plurality of rods 24 positioned with the midpoint of each rod on the axis and each rod of the plurality positioned in separate generally parallel planes, a first end of each rod affixed to a first of the arcuate surfaces and a second end of each rod affixed to a second of the arcuate surfaces.

The rods utilized in the present invention are generally elongated and can have any desired shape. For example, rods or bars can conveniently be utilized. Rods (circular cross-section) are preferred because of ready availability, a more streamlined cross section, and the capability of generating vortex sheets especially when oriented approximately normally to the direction of shell side fluid flow. For heat exchange purposes, rods are thus preferred. For best results, each rod should have a width, preferably a diameter, which is equal to the spacing between the tube rows less the diameter of a tube, i.e. the width of a lane between two tube rows. By utilizing such a feature, a tube bundle having good resistance to vibration induced damage and good heat transfer capabilities can be easily constructed. In the embodiments illustrated, the arcuate surfaces 18 and 20 to which the ends of the rods 24 are affixed are portions of generally annular surfaces which encircle the tube bundle. Most preferably, each generally annular surface is defined by an end of a tubular member 26. In the embodiments of the invention shown in FIGS. 1–8, the tubular member 26 has a longitudinal dimension which is small, for example, less than 10% with respect to its diameter, and can aptly be described as a ring. In the embodiments of the invention shown in FIGS. 9–13, the tubular member 26 has a substantial longitudinal dimension, for example, a length greater than about 10% of its diameter and can best be described as a band. The annular surfaces to which the rods 24 are affixed can be different ends of the same tubular member see FIGS. 9–13; or ends of different tubular members as desired. In the embodiments of the invention illustrated by the FIGURES the ends of the rods of a single plurality of rods are affixed to a pair of generally arcuate, annular surfaces which face in opposite directions. If desired, the rods can be affixed to arcuate surfaces which face in the same direction.

Preferably, according to the invention, the annular surfaces to which the rods are affixed are positioned in planes which are substantially perpendicular to the longitudinal axis of the tube bundle. This is an important feature of the preferred embodiment of the present invention because to ease of construction. Essentially circular rings can be employed. Prior art apparatus having obliquely arranged elements employed eliptical shapes, which were extremely difficult to construct to close tolerances, especially when temperature expansion and contraction were allowed for. When generally circular rings or bands encircle the tube bundle and the ends of the rings or bands lie in planes which are substantially perpendicular to the axis to the tube bundle, it is a simple matter to construct baffles according to the invention to close tolerances. Preferably, and as illustrated, the rods 24 lie in generally parallel planes which are substantially evenly spaced apart to correspond to the lanes through the tube bundle. It will be appreciated however, that the rods do not all lie in the same plane. In this manner, each baffle of the set can be substantially identical to the other baffles, differing only in its orientation by rotation with respect to the axis of the bundle. It is important to note in accordance with this feature of the present invention, especially as illustrated by FIGS. 9–14, that a four step spiral is formed with at least four baffles being required to form the spiral, where the tubes have been laid out on a square pitch.

In the embodiment of the invention shown by FIGS. 1–8, each arcuate portion of the annular surface to which rods are attached has a span of between about 120 and 175 degrees. The pair of arcuate portions are separated, as measured center to center with respect to the longitudinal axis of the tube bundle by an angle of about 180°. In the embodiments of the invention as shown by FIGS. 9–13, each arcuate portion of the annular surface at the end of each tubular member to which rods are affixed has a span of between about 60° and 85°. Here also, the a pair of arcuate portions are separated, as measured center to center with respect to the longitudinal axis of the tube bundle by an angle of about 180°.

Generally speaking, the baffle set for causing longitudinally spiralling flow of shell side fluid through the tube bundle will comprise a plurality of baffles, usually at least 3. For ease of construction, the tube bundle is laid out on square pitch, and each baffle of a baffle set is substantially identical, differing by only its rotation about the axis of the tube bundle. Preferably, where the tube bundle is laid out on square pitch, each baffle set comprises a first baffle, a second baffle, a third baffle, and a fourth baffle serially arranged. These features of the invention are shown in FIGS. 2, 4, 6, 8, 10–13, and suggested by FIGS. 15 and 17. As shown by the FIGURES the baffles are spaced apart along the longitudinal axis of the tube bundle and the second baffle is oriented at a 90° angle of rotation about the longitudinal axis of the tube bundle with respect to the first baffle, (e.g. compare FIG. 4 to FIG. 2), the third baffle is oriented at a 90° angle of rotation from the second baffle and at a 180° angle of rotation from the first baffle, (e.g. compare FIG. 6 to FIG. 4 and 2), and the fourth baffle is oriented at a 90° angle of rotation from the third baffle and at a 180° angle of rotation from the second baffle, (e.g. compare FIG. 8 to FIGS. 6 and 4).

As previously mentioned, it is preferred that each baffle set provide radial support at least once for each tube of the bundle. It is further prefered that a tube bundle constructed in accordance with the present invention be supported by a plurality of baffle sets. Where the tube bundle is to be employed for gas service, rings or bands 26 should be spaced apart longitudinally with respect to the bundle axis at a spacing of between about 6 to 12 inches (0.15–0.31 m), center to center. Where the tube bundle is to be employed for liquid service, a baffle spacing of between about 10 and 18 inches (0.25–0.45 m) is preferred. As measured with respect to a plane normal to the longitudinal axis of the tube bundle the rods when positioned according to the present invention will typically form angles between about 10° and 60° with respect to the plane.

From the embodiments of the invention shown by FIGS. 1–8, adjacent baffles could be slid together along the axis of the tube bundle so that each ring 26 of a baffle contacts the next adjacent ring 26 of the adjacent baffle. Where this close of a baffle spacing is desired, it can be advantageous to affix rods 24 to both ends of each ring 26 with the rods having a component extending in upstream and downstream directions with respect to the ring. Thus, when utilizing this aspect of the invention, a baffle set of 4 baffles could be formed from 5 rings rather than 8 as shown by the FIGURES.

Figure 15:
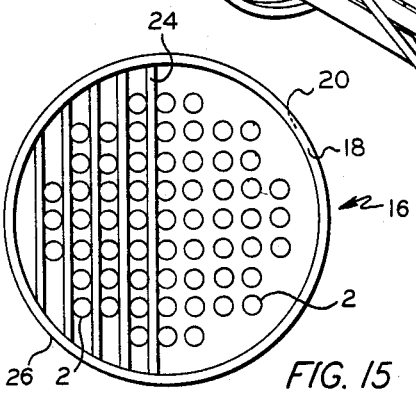
FIGS. 15 and 17 are cross-sectional views taken along the lines indicated in FIGS. 14 and 16.
Figure 17:
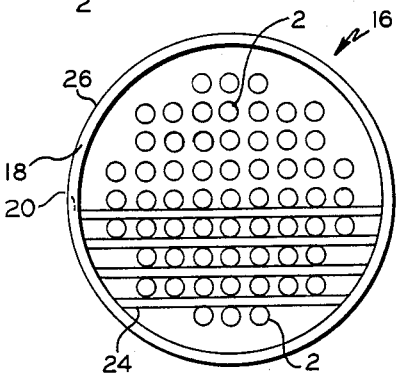
Figure 16:
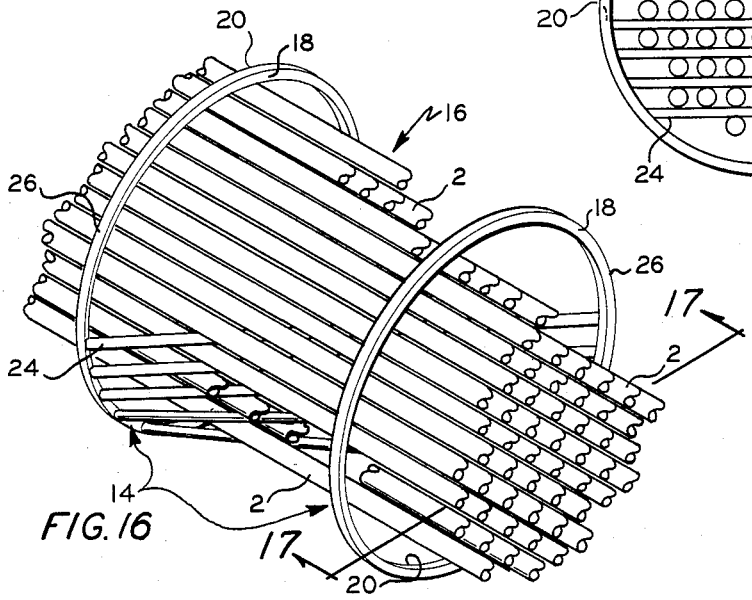

Referring now to FIGS. 14–17, the illustrated baffle set provides for a single helix flow of shell side fluid through the bundle by providing each baffle with rods extending through the tube bundle to form a segment-shaped appearing rod baffle when seen in plan view (FIGS. 15 and 17). Radial support is provided for each tube in the bundle by utilizing a rod in every available lane through the segment and a sufficient number of baffles (not shown) to provide each tube of the bundle with radial support. Here, the rods in each baffle are spaced across only about one-half of the tube bundle, in adjacent lines of a single plurality.

Where a double flow pattern of rods is utilized as shown by FIGS. 9–13, it is preferred that the rods in each baffle which are spaced across the first half of the tube bundle be affixed by their first ends to a first quarter of the generally annular surface presented by one end of the band and by their second ends to a first quarter of the generally annular surface presented by the other end of the band, and that the rods in each baffle which are spaced apart across the second half of the tube bundle in a portion of the lanes be affixed by their first ends to a second quarter of the first generally annular surface presented by one end of the band and a second quarter of the second generally annular surface presented by another end of the band and that the first and second quarters of each generally annular surface be spaced apart, center to center with respect to the axis of the tube bundle, by an angle of about 180°.

In the method for improving the capability of the tube bundle for mixing shell side fluid in accordance with the present invention when the tube bundle is to be employed in a shell and tube heat exchanger, the tube bundle is provided with a plurality of encircling rings or bands 26 spaced apart longitudinally along the tube bundle and dividing the tube bundle into portions having a longitudinal dimension and through which there extend rods. Pluralities of rods extend transversely through each portion of the tube bundle, a plurality of rods in a portion of the bundle, with each of the rods having a first end attached to one end of the ring or band, and a second end attached to a second, different end of right or band. Rods traversing adjacent portions of the tube bundle pass through different pluralities of parallel lanes, usually offset 90°, so that shell side fluid passes through the tube bundle in preferably longitudinally spiraling flow. About the longitudinal axis of the tube bundle. Preferably, the rods extending through adjacent portions of the bundle are alternately positioned in at least a portion of the lanes between the first plurality of parallel tube rows in one portion of the bundle and at least a portion of the lanes between the second plurality parallel tube rows in the adjacent portion of the bundle. The rods in four adjacent portions of the bundle provide radial support at least once for each tube in the bundle.

That which is claimed is:

1. Apparatus for supporting tubes in a tube bundle having a longitudinal axis, said apparatus comprising:

a tubular member having a first end and a second end, the first end forming a first arcuate surface and the second end forming a second arcuate surface, said first arcuate surface and said second arcuate surface together forming a pair of arcuate surfaces positioned symmetrically with respect to an axis between the pair and lying in separate planes generally parallel to the axis between the pair; and a plurality of straight rods positioned with their midpoints on said axis between the pair and lying in separate generally parallel planes for extending transversely through the tube bundle in a direction which is not normal to the longitudinal axis of the tube bundle, a first end of each rod affixed to the first arcuate surface of the pair of arcuate surfaces and a second end of each rod affixed to the second arcuate surface of the pair of arcuate surfaces.

2. Apparatus for supporting tubes in a tube bundle having a longitudinal axis, said apparatus comprising:

a first annular ring having a first end and a second end, each of said first end and said second end of the first annular ring forming an arcuate surface, a second annular ring having a first end and a second end, each of said first end and said second end of the second annular ring forming an arcuate surface, said the first end of said first annular ring and the first end of said second annular ring together forming a pair of arcuate surfaces positioned symmetrically with respect to an axis between the pair and lying in separate planes generally parallel to the axis between the pair; and a plurality of straight rods positioned with their midpoints on said axis between the pair and lying in separate generally parallel planes for extending transversely through the tube bundle in a direction which is not normal to the longitudinal axis of the tube bundle, a first end of each rod affixed to a first arcuate surface of the pair of arcuate surfaces and a second end of each rod affixed to a second arcuate surface of the pair of arcuate surfaces;

wherein the first arcuate surface of the pair of arcuate surfaces is formed by the first end of the first annular ring; and wherein the second arcuate surface of the pair of arcuate surfaces is formed by the first end of the second annular ring.

3. Apparatus as in claim 2 wherein the first arcuate surface and the second arcuate surface face in opposite directions.

4. Apparatus as in claim 2 wherein the first arcuate surface and the second arcuate surface face in the same direction.

5. Apparatus as in claim 2 wherein the generally parallel planes in which the rods lie are substantially evenly spaced apart.

6. Apparatus as in claim 3 wherein the generally parallel planes in which the rods lie are substantially evenly spaced apart.

7. Apparatus as in claim 4 wherein generally the parallel planes in which the rods lie are substantially evenly spaced apart.

8. Apparatus as in claim 7 wherein each arcuate surface to which the rods are affixed has a span of between about 60 and about 85 degrees.

9. Apparatus as in claim 8 wherein the rods are affixed to a pair of arcuate surfaces, said pair of arcuate surfaces being separated as measured circumferentially with respect to the longitudinal axis of the tube bundle from the center of one arcuate surface to the center of the other arcuate surface of the pair, by an angle of about 180°.

10. Apparatus as in claim 7 wherein the rods are affixed to a pair of arcuate surfaces, said pair of arcuate surfaces being separated, as measured, circumferentially with respect to the longitudinal axis of the tube bundle, from the center of one arcuate surface to the center of the other arcuate surface of the pair, by an angle of about 180°.

11. Apparatus as in claim 7 wherein each arcuate portion of the annular surface to which the rods are affixed has a span of between about 120° and 175°.

12. Apparatus comprising:

a plurality of tubes forming a tube bundle suitable for use in a shell and tube heat exchanger, said tubes positioned to form at least a first plurality of parallel tube rows and a second plurality of parallel tube rows, and lanes between at least a portion of adjacent tube rows; and at least one baffle set comprising a plurality of baffles cooperating with said tube bundle to cause longitudinally spiraling flow of shell side fluid through the tube bundle; wherein each baffle of the set comprises:

at least one outer ring surrounding the tube bundle and having a pair of ends defining a first generally annular surface and a second generally annular surface, said first and said second generally annular surfaces lying in generally parallel planes longitudinally spaced apart along a longitudinal axis of the tube bundle; and a plurality of straight rods lying in separate generally parallel planes each having a first end and a second end and positioned in at least a portion of the lanes between adjacent tube rows in a direction which is not normal to the longitudinal axis of the tube bundle in one plurality of parallel tube rows, each of the rods attached by its first end to one of the generally annular surfaces and by its other end to the other of the generally annular surfaces.

13. Apparatus as in claim 12 wherein the tubes are laid out in square pitch, and wherein each baffle of a baffle set is substantially identical.

14. Apparatus as in claim 13 wherein each baffle set comprises a first baffle, a second baffle, a third baffle, and a fourth baffle serially arranged.

15. Apparatus as in claim 14 wherein the baffles are spaced apart along the longitudinal axis of the tube bundle and the second baffle is oriented at a 90° angle of rotation about the longitudinal axis of the tube bundle with respect to the first baffle, the third baffle is oriented at a 90° angle of rotation from the second baffle and at a 180° angle of rotation from the first baffle, and the fourth baffle is oriented at a 90° angle of rotation from the third baffle and at a 180° angle of rotation from the second baffle.

16. Apparatus as in claim 15 wherein the baffle set provides radial support at least once for each tube in the bundle.

17. Apparatus as in claim 16 comprising a plurality of baffle sets.

18. Apparatus as in claim 16 wherein the rods in each baffle are spaced apart substantially across the tube bundle.

19. Apparatus as in claim 16 wherein the rods in each baffle are spaced apart across about one-half of the tube bundle.

20. Apparatus as in claim 18 wherein the rods in each baffle which are spaced apart across a first half of the tube bundle are affixed by their first ends to a first quarter of the first generally annular surface and by their second ends to a first quarter of the second generally annular surface, and the rods in each baffle which are spaced apart across a second half of the tube bundle are affixed by their first ends to a second quarter of the first generally annular surface and a second quarter of the second generally annular surface; wherein the first and second quarters of each generally annular surface are spaced apart, as measured circumferentially with respect to the axis of the tube bundle from the center of the first quarter to the center of the second quarter by an angle of about 180°.

* * * * *